United States Patent [19]

Shapiro et al.

[11] 4,007,039

[45] Feb. 8, 1977

[54] COPPER BASE ALLOYS WITH HIGH STRENGTH AND HIGH ELECTRICAL CONDUCTIVITY

[75] Inventors: Stanley Shapiro, New Haven; Eugene Shapiro, Hamden; Brian Mravic, North Haven; W. Gary Watson, Cheshire, all of Conn.

[73] Assignee: Olin Corporation, New Haven, Conn.

[22] Filed: Mar. 17, 1975

[21] Appl. No.: 559,307

[52] U.S. Cl. ..... 75/153; 75/164; 148/160

[51] Int. Cl.[2] ..... C22C 9/00

[58] Field of Search ..... 75/153, 164, 159; 148/2, 12.7, 160, 32.5, 13.2

[56] References Cited

UNITED STATES PATENTS

| | | | |
|---|---|---|---|
| 2,069,906 | 2/1937 | Vaders | 75/153 X |
| 2,086,604 | 7/1937 | Comstock | 75/164 |
| 2,943,960 | 7/1960 | Saarivirta | 75/164 X |
| 3,773,505 | 11/1973 | Nesslage et al. | 75/164 |

FOREIGN PATENTS OR APPLICATIONS

| | | | |
|---|---|---|---|
| 1,154,641 | 9/1963 | Germany | 75/164 |
| 1,254,869 | 11/1967 | Germany | 75/164 |

*Primary Examiner*—Walter R. Satterfield
*Attorney, Agent, or Firm*—Robert A. Dawson; Robert H. Bachman; David A. Jackson

[57] ABSTRACT

New and improved copper base alloys, characterized by a combination of high electrical conductivity and excellent strength properties, consisting essentially of 0.8 – 5% by weight of titanium, a portion of which may be a like element such as zirconium or hafnium or both, 1.2 – 5% by weight of antimony, part of which may be replaced by one or more of the elements arsenic, phosphorus, silicon, germanium and tin, with the atomic ratio of the total titanium, and like elements, to antimony, and like elements, being 5:3 or somewhat less, and the balance essentially copper. The desired properties are attained by the proper application of mechanical processing steps and thermal treatments.

4 Claims, No Drawings

COPPER BASE ALLOYS WITH HIGH STRENGTH AND HIGH ELECTRICAL CONDUCTIVITY

BACKGROUND OF THE INVENTION

A variety of copper base alloys have been proposed in the past in attempts to fill the need for a metallic composition capable of displaying a desirable combination of high mechanical strength properties and high electrical conductivity. Among these, copper alloys consisting of copper alloyed with 0.08 to 0.7% by weight of titanium and 0.05 to 1% by weight of antimony have been described in U.S. Pat. Nos. 3,773,505 and 3,832,241 to Donald J. Nesslage and Lin S. Yu, as capable of maintaining moderately high mechanical strength while overcoming undesirably low conductivities.

However, these patents teach that the addition of up to a total of about one percent of titanium and antimony, in a proportion of 0.3 to 0.8 parts by weight of antimony per part by weight of titanium and antimony, increases the ultimate tensile strength, but that on further addition of these ingredients beyond one percent, the gain in strength is less significant. Further, it is stated that the titanium content of the alloy should be about 0.1 to 0.2% by weight for greater emphasis on conductivity and about 0.3 to 0.4% by weight for greater emphasis on tensile strength.

In accordance with the present invention, it has been found that improved copper base alloys may readily be prepared, contrary to the above-recited teachings and indications, which are capable of displaying significantly higher strength properties and excellent conductivity values, by the provision in the copper base alloy of substantially higher proportions of titanium and antimony, and that a portion of each of these elements may effectively be replaced by one or more like elements.

SUMMARY OF THE INVENTION

Accordingly, the present invention provides new and improved copper base alloys, which consist essentially of 0.8 – 5% by weight of titanium, part of which may be replaced by zirconium or hafnium or both, 1.2 – 5% by weight of antimony, part of which may be replaced by one or more of the elements arsenic, phosphorus, silicon, germanium and tin, with the atomic ratio of the total titanium and like elements, designated as Ti, to antimony and like elements, designated as Sb, being equal to or close to, but not substantially over 5:3, and the balance essentially copper.

The invention likewise contemplates the application of the proper schedule of process steps for the cast alloy, including hot rolling or cold rolling or both to the desired extent, and one or more intermediate and final thermal treatments, to accomplish the separation of finely dispersed, mainly intragranular, precipitate throughout the alloy, so as to effect the attainment of the desired combination of high electrical conductivity and remarkable mechanical properties. Thus, the treated alloy is characterized by unusual toughness and strength, together with adequate ductility to permit readily the required handling and forming operations to produce the desired article.

Thus, the main objective of the present invention has been to provide a copper base alloy which contains at least 0.8% by weight of titanium and at least 1.2% by weight of antimony, and a process for treating the said alloy thermally and mechanically, in order to produce articles characterized by unusually high mechanical properties as well as by excellent electrical conductivity.

Another object has been to furnish copper base alloys which include titanium and antimony in substantially higher proportions than considered feasible in the prior art, and to control the composition and provide a process for the treatment thereof so that the product displays unusually high mechanical strength together with excellent electrical conductivity.

Other objects and advantageous features of the invention will become more apparent to those skilled in the art from the following detailed description of the preferred compositions and procedures in accordance with the present invention.

DESCRIPTION OF THE PREFERRED EMBODIMENTS

The advance in the art accomplished in accordance with the present invention requires that copper of adequate purity be alloyed with 0.8 to 5% by weight of titanium and 1.2 to 5% by weight of antimony. The desired high strength properties and excellent electrical conductivity are likewise attained when limited amounts of certain additional elements are present. A portion, up to about one-fifth, of the titanium may be substituted for by a like element such as zirconium or hafnium or both. Also, a substantial portion of the antimony may be replaced by one or more like elements, such as arsenic, phosphorus, silicon, germanium and tin. Preferably, the alloy contains 0.9 to 3% titanium, 1.3 to 4.5% antimony, and balance essentially copper. Further, it is essential that the atomic ratio of the total titanium and like elements to the antimony and like elements be equal to or close to, but not substantially in excess of, the ratio 5:3. This is a critical feature in that when the alloy composition is such that the atomic ratio $\Sigma$ Ti: $\Sigma$ Sb substantially exceeds 5:3, for example by 10%, this is accompanied by a substantial decrease in the conductivity. In contrast, up to 20% excess amounts of antimony cause but relatively slight decrease in the conductivity. Additional elements may be used in the alloy composition in limited amounts, such as up to a total of 0.5% by weight for all such additives, for the enhancement of certain features or properties and without significantly changing the strength and conductivity properties. For example, a small but effective amount of a deoxidizer element such as aluminum, magnesium, boron or misch metal may be added with advantage to the molten alloy. Likewise, a slight content of lead, selenium, or tellurium may be present for improving the machinability of the alloy. Certain of the additives previously mentioned may exert more than one functional effect in the alloy, as for example phosphorus also exerts deoxidizing action, and arsenic also imparts improved corrosion resistance.

The alloys of this invention may be prepared as molten metal by the conventional operation of known melting equipment, the alloying additions being made by any convenient method, including the use of copper master alloys. Likewise, alloy ingots are cast using conventional equipment and techniques.

The combination of optimum strength characteristics and electrical conductivity is developed in the alloys through a properly coordinated schedule of mechanical operations to reduce the cross-section, such as extrusion, forging, wire drawing, or preferably hot and cold rolling, and intervening thermal treatments to anneal the alloy or to bring the alloy constituents into solution, and aging treatments to effect the desired precipitation throughout the alloy of finely-dispersed particles formed of alloy constituents. Aging may be effected at 250° to 500° C for ½ to 24 hours, preferred conditions for thermal treatments being set forth in the following specific examples. Excellent results may be obtained by repeating a cycle of thermal treatment, mechanical working, and aging one or more times. The extent of working and of the time and/or temperature of the thermal treatments may be varied according to requirements. Also, the thermal treatments may include short time recrystallization treatments controlled to result in reduced grain size without affecting the homogeneity. A final low temperature thermal treatment in the range of 150° to 300° C for a period of 15 minutes to 24 hours may be applied as a final processing step. This thermal treatment enhances the final conductivity and ductility of the alloy, without appreciably reducing the strength.

EXAMPLE I

An alloy having the composition 1.97% by weight titanium, 3.01% by weight antimony, and the balance copper was cast, hot rolled, solution annealed for 2 hours at a temperature of 875° C, cold rolled to 75% reduction in thickness, precipitation hardened for 2 hours at an aging temperature of 500° C and cold rolled 75%. Properties are shown in Table I.

EXAMPLE II

The alloy of Example I was treated as above, except that the aging treatment was for 2 hours at 400° C. Properties are shown in Table I.

EXAMPLE III

The alloy of Example I was treated as in Example I, except that cold work before aging was omitted. Properties are shown in Table I.

TABLE I

| Example | Electrical Conductivity % IACS | Yield Strength 0.2% Offset ksi | Ultimate Tensile Strength ksi | Elongation in 2 Inches % |
|---|---|---|---|---|
| I | 81 | 70 | 77 | 3 |
| II | 65 | 73 | 79 | < 1 |
| III | 67 | 70 | 75 | 4 |

EXAMPLE IV

An alloy having the composition, in percent by weight, of 0.87% titanium, 1.45% antimony and balance copper was melted at a temperature above 1300° C and cast at 1200° to 1250° C. This alloy contained an excess of Sb, amounting to 0.13% by weight, over the atomic ratio Ti:Sb of 5:3. The ingot was hot rolled at 825° C to about 0.5 inch thickness, then solution annealed at 925° C for 2 hours, and water quenched. After the surface was milled, the alloy slab was cold rolled 75%, given an aging treatment for ½ hour at 450° C, and again cold rolled 75%.

EXAMPLE V

The procedure of Example IV was repeated on an alloy of copper with 0.87% Ti and 0.76% Sb. This alloy contained an excess of Ti, amounting to 0.37% by weight, over the atomic ratio of Ti:Sb of 5:3.

EXAMPLE VI

The procedure of Example IV was repeated on an alloy of copper with 0.94% Ti and 1.49% Sb. This alloy contained an excess of Sb, amounting to 0.06% by weight, over the atomic ratio of Ti:Sb of 5:3.

Measurements made on the alloys of Examples IV, V and VI following solution treatment and after each indicated treatment are summarized in Table II below.

TABLE II

| Process Step | Example | Vickers Hardness | Conductivity % IACS | Ultimate Tensile Strength UTS-KSI | 0.2% Yield Strength YS |
|---|---|---|---|---|---|
| A | IV | 58 | 22.5 | — | — |
| Solution | V | 59 | 16.0 | — | — |
| Treated | VI | 62 | 21.0 | — | — |
| B | IV | 163 | 22.5 | — | — |
| A+CR 75% | V | 149 | 16.0 | — | — |
| | VI | 160 | 21.0 | — | — |
| C | IV | 190 | 67.0 | — | — |
| B+450° C/½hr | V | 175 | 23.5 | — | — |
| | VI | 188 | 63.0 | — | — |
| D | IV | 241 | ~ 63.0 | 109 | 102 |
| C+CR 75% | V | — | ~ 23.5 | — | — |
| | VI | 235 | ~ 60.0 | 107 | 101½ |

It is noteworthy that the ultimate tensile strength values of the alloys listed in Table I of U.S. Pat. No. 3,773,505 range from 48.8 to 86.1 ksi, the values being substantially lower than those for examples D IV and D VI. Furthermore, the results for example D V indicate that Ti in excess of the 5:3 ratio has a markedly deleterious effect on the electrical conductivity.

EXAMPLE VII

In order to make a more direct comparison with an example of the above patent, the alloy compositions of above Examples IV and VI were processed in accordance with a schedule equivalent to that set forth for the first sample in Table V, column 6 of U.S. Pat. No. 3,773,505, consisting of solution heat treatment at 925° C, cold rolling 75% and aging for 2 hours at 450° C.

The resulting measured values were as follows:

| Example | Conductivity | Hardness Rockwell B |
|---|---|---|
| IV | 71 | 92 |
| VI | 72 | 92 |
| U.S. 3,773,505 | 74 | 84 |

-continued

| Example | Conductivity | Hardness Rockwell B |
|---|---|---|
| (lst alloy of Table V) | | |

Thus, at comparable conductivity values, the alloys in accordance with this invention provide greater hardness, the increase amounting to 8 units, which corresponds to a strength increase of about 10,000 pounds per square inch.

EXAMPLE VIII

The procedure of Example VII was applied to an alloy composition of copper alloyed with 1.32% by weight of titanium, 0.77% antimony and 0.34% silicon. The treated alloy displayed a conductivity value of 60% IACS and Vickers Hardness value of 182. Thus, an excellent conductivity value was obtained in a metallic composition displaying extraordinary hardness and strength.

The above Examples illustrate the capability of attaining excellent electrical conductivity in combination with remarkably high strength, toughness and hardness in accordance with the alloy compositions and preferred treating procedures of this invention. It will be understood by those skilled in the art that various modifications may at times by employed advantageously in the illustrative examples, within the scope of the appended claims.

What is claimed is:

1. A process for producing a high conductivity and high strength copper base alloy comprising the steps of preparing a molten alloy consisting essentially of 0.8 to 5% titanium, 1.2 to 5% antimony, balance copper, wherein the titanium and antimony are present at an atomic ratio of not more than 10% above 5 atoms of titanium per 3 atoms of antimony, casting said alloy, then mechanically reducing the cross-section of the cast alloy in successive steps with intervening thermal treatments, and subjecting the alloy to an aging treatment at 250° to 500° C for ½ to 24 hours.

2. A process according to claim 1, wherein the said successive steps include hot rolling and cold rolling said alloy.

3. A process according to claim 1, wherein said thermal treatments include a solution annealing step.

4. A process according to claim 1, wherein said steps include a final low temperature thermal treatment at 150° to about 300° C.

* * * * *